US011166865B2

(12) United States Patent
Jannotta

(10) Patent No.: US 11,166,865 B2
(45) Date of Patent: Nov. 9, 2021

(54) VARIABLE ARCHING SUPPORT FOR TORSO FLEXIBILITY

(71) Applicant: Anthony S. Jannotta, Silver Spring, MD (US)

(72) Inventor: Anthony S. Jannotta, Silver Spring, MD (US)

( * ) Notice: Subject to any disclaimer, the term of this patent is extended or adjusted under 35 U.S.C. 154(b) by 0 days.

(21) Appl. No.: 16/231,874

(22) Filed: Dec. 24, 2018

(65) Prior Publication Data

US 2020/0197252 A1 Jun. 25, 2020

(51) Int. Cl.
*A61H 1/02* (2006.01)
*A63B 23/00* (2006.01)

(52) U.S. Cl.
CPC ... *A61H 1/0292* (2013.01); *A61H 2001/0203* (2013.01); *A63B 2023/006* (2013.01)

(58) Field of Classification Search
CPC .... A61H 1/02–0296; A61H 2015/0014–0035; A63B 2023/006; A63B 21/00047; A63B 21/00178; A63B 21/4033; A63B 23/02–0211; A63B 23/0233–0238; A47B 1/06; A47B 3/04
USPC ..... 606/237–245
See application file for complete search history.

(56) References Cited

U.S. PATENT DOCUMENTS 2,475,003 A * 7/1949 Black ..... A61H 1/0218 606/243
2,840,072 A * 6/1958 Stearns ..... A61H 15/0078 601/115
3,687,133 A * 8/1972 Grubelic ..... A61H 15/0078 601/102
3,766,912 A * 10/1973 Daniels ..... A61H 1/0229 606/242
4,927,139 A * 5/1990 Taltre ..... A63B 21/00047 482/142
5,054,472 A * 10/1991 Stefan ..... A61H 15/0078 601/116
5,468,216 A * 11/1995 Johnson ..... A61H 1/0292 5/616
5,531,658 A * 7/1996 L. S. C. ..... A63B 23/0222 482/142
5,904,641 A * 5/1999 Huang ..... A61H 1/0244 482/131
10,172,758 B1 * 1/2019 Downs ..... A61H 1/02
2010/0049097 A1 * 2/2010 O'Brien ..... A61H 1/0218 601/1
2011/0040219 A1 * 2/2011 Tanner ..... A61H 1/0292 601/128
2011/0125070 A1 * 5/2011 Lu ..... A61H 1/0292 601/115

* cited by examiner

*Primary Examiner* — Jennifer Robertson
*Assistant Examiner* — Catrina A Letterman
(74) *Attorney, Agent, or Firm* — Michael J. Foyck, Jr.

(57) ABSTRACT

A stretching and exercising device is beneficial for torso flexibility, having a configurable structure in which the curvature of the platform is adjustable. The platform can be varied in curvature from a substantially flat configuration to a generally semi-circular configuration. The platform is supported by a gear train connected to the platform, wherein the platform has a plurality of discrete parts. An adjustment member having a manually adjustable variable length connects opposite ends of the gear train, so that the curvature of the platform is determined by the adjusted length of the adjustment member.

7 Claims, 13 Drawing Sheets

CONFIGURATION C

CONFIGURATION B

VARIABLE ARCHING SUPPORT FOR TORSO FLEXIBILITY

CROSS REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to stretching and exercising devices, and more specifically relates to a variable arching support for torso flexibility.

BACKGROUND OF THE INVENTION

It is a problem in the art to provide stretching or exercising devices that are beneficial for torso flexibility. It is also a problem in the art to provide reconfigurable devices for stretching and exercising, that allow stretching or exercising in more than one way.

It is also a problem in the art to provide a stretching or exercising device that has a curved platform, wherein the curvature of the platform is adjustable.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a stretching or exercising device that is beneficial for torso flexibility.

The device of the present invention also provides a reconfigurable structure for stretching and exercising, that allows stretching and exercising in more than one way.

The present invention also provides a stretching or exercising device that has a platform, wherein the curvature of the platform is adjustable. The platform can be varied in curvature from a substantially flat configuration to a generally semi-circular configuration.

The platform is supported by a gear train connected to the platform, wherein the platform has a plurality of discrete parts. An adjustment member having a manually adjustable variable length connects opposite ends of the gear train, so that the curvature of the platform is determined by the adjusted length of the adjustment member.

Other objects and advantages of the present invention will be more readily apparent from the following detailed description when read in conjunction with the accompanying drawings.

DETAILED DESCRIPTION OF THE INVENTION

Figure 1:
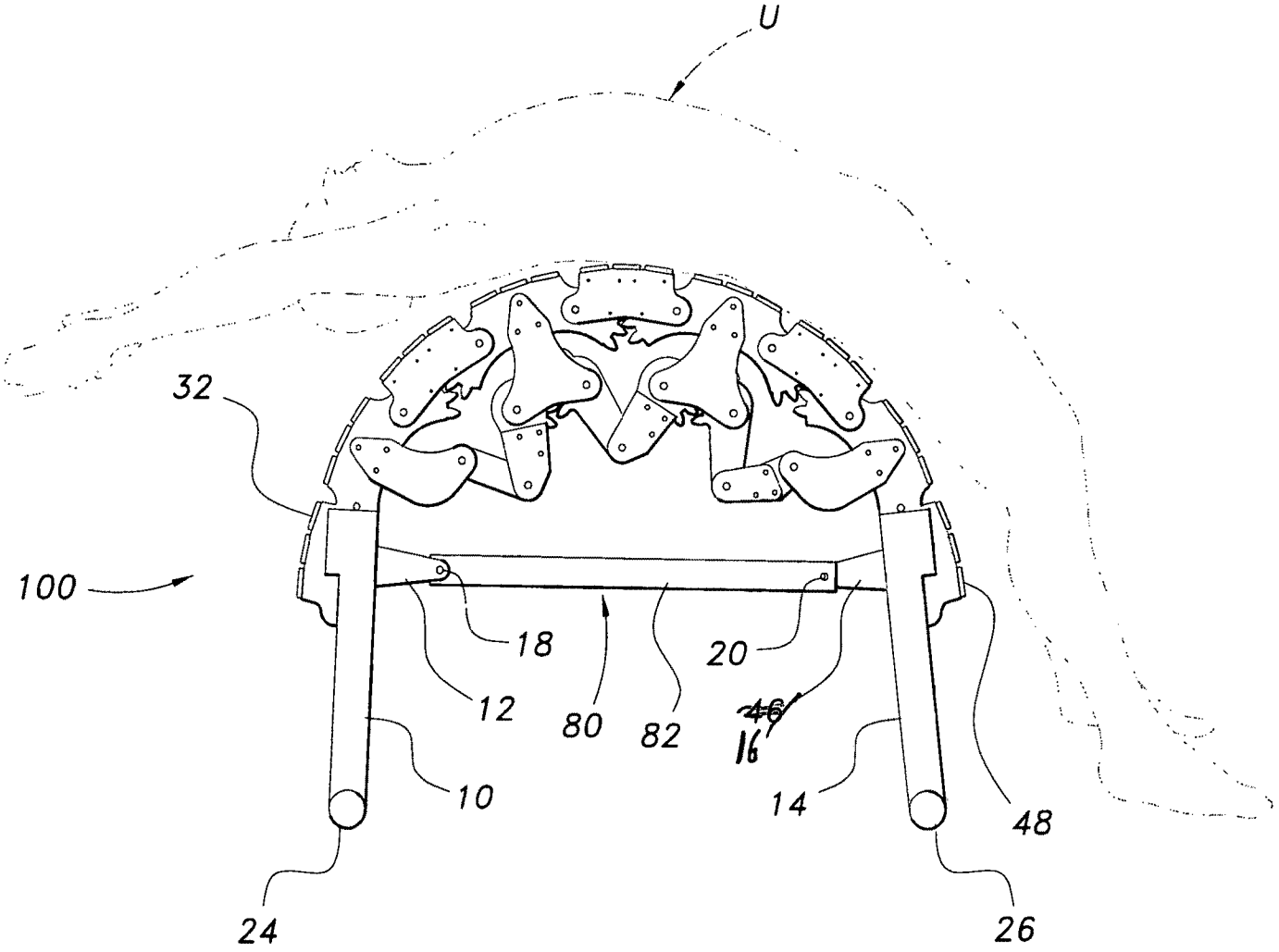
FIG. 1 is a side elevational view which is an environmental view, showing the device of the present invention including a gear train and a platform, the platform having an upper surface to support a human body shown in phantom outline.

A device 100 for use in stretching and exercise is shown in FIG. 1, which is a side elevational view which also shows a dashed outline of a human user U. The device 100 includes a gear train 60 (as numbered and shown in FIG. 3), a platform 50 (as numbered and shown in FIG. 3), a first support leg 10, a second support leg 14, and an extension member 80 which includes a bar 82. The extension member 80 has a pin 20 allowing an adjustment in length, as described further below with regard to FIG. 4 which shows the adjustment mechanism.

A variety of conventional accessories can be used with the device 100, which are known in the field of exercise equipment. For example, straps can be provided to secure any of: the legs, feet, arms, hands, head, shoulders, waist, and hips. Also, pads can be provided on various surfaces, and any materials can be provided for the equipment which would be known to any one having skill in the exercise equipment arts. Also, a remote pin adjustment mechanism can be provided for adjustment of any pin such as the pin 20, such as by a pulley mechanism (not shown), a gear mechanism (not shown), an electronic device (not shown), or any other remote mechanism which would be known to any one having skill in the exercise equipment arts.

The bar 82 is a manually adjustable telescoping member whose length determines the extent of curvature of the platform 50. The platform 50 (numbered in FIG. 3, and shown unnumbered in FIG. 1) has an upper surface to support a human body shown in phantom outline. FIG. 1 illustrates the device 100 in a first Configuration, labeled Configuration 1. In FIG. 1, the platform 50 (numbered in FIG. 3, not numbered in FIG. 1 for the sake of clarity) is configured in a full arc, which is the maximum curvature.

Figure 3:
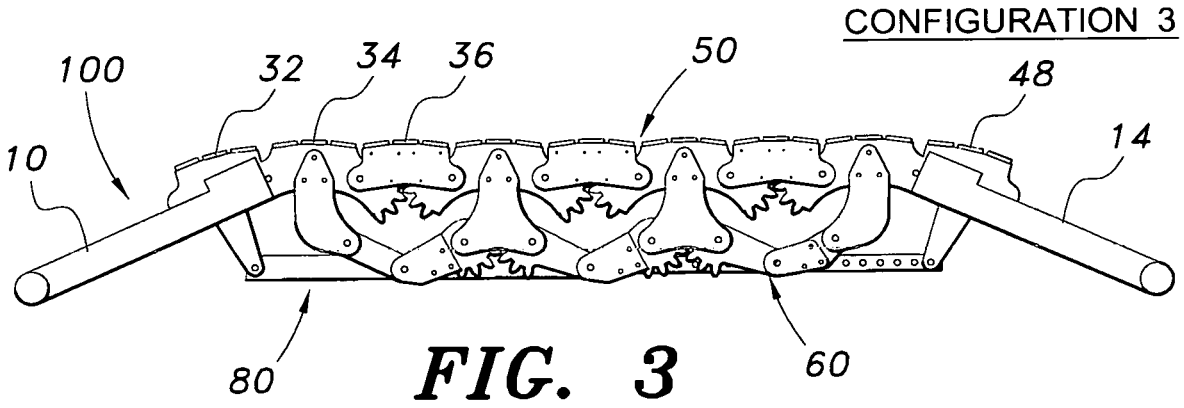
FIG. 3 is side elevational view of the device of FIG. 1, showing the platform in a flat configuration.
Figure 4:
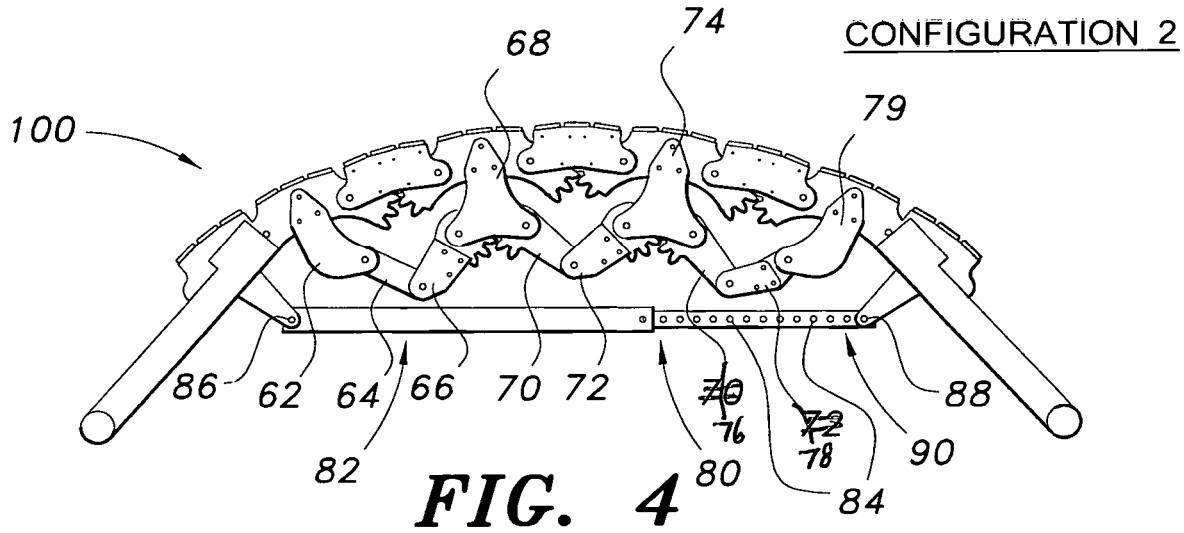
FIG. 4 is a side elevational view similar to FIG. 3, wherein the platform is shown in a configuration that is in mid-arc.
Figure 5:
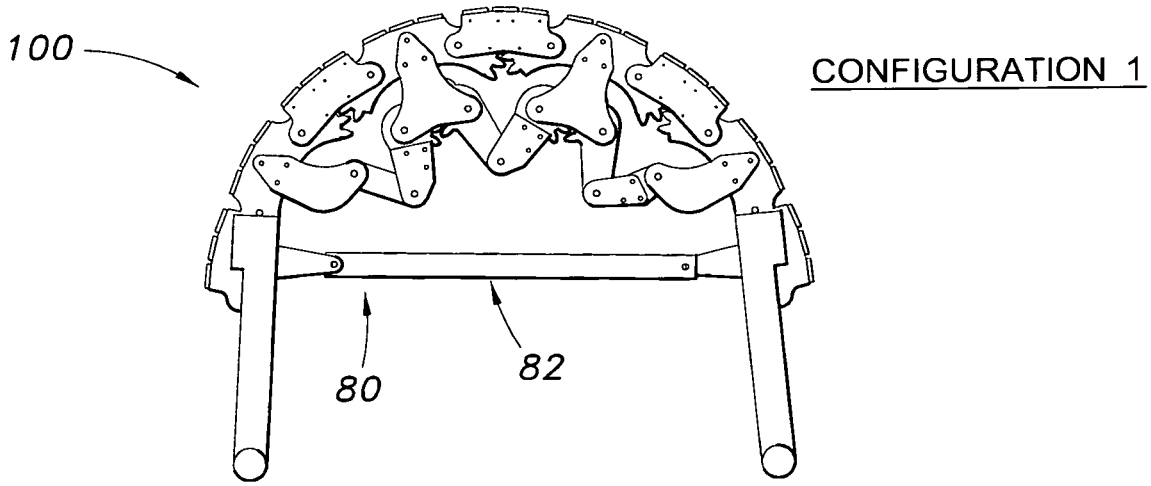
FIG. 5 is a side elevational view similar to FIGS. 3 and 4, wherein the platform is shown in a configuration that is in full-arc.

The device 100 provides a means of gradually and gently increasing strength and flexibility of the torso (or trunk, roughly from the hips to the neck) of the body of a user U. This is accomplished by a variable circular "arch" shaped platform which can be adjusted from a flat shape (FIG. 3) to a semi-circular or full-arc shape (FIG. 5), to an intermediate position in between (exemplified in FIG. 4). The full-arc shape of FIG. 5 is hereafter referred to as a first configuration, labeled as Configuration 1 in FIG. 5; the flat shape of FIG. 3 is referred to hereafter as a third configuration, labeled as Configuration 3 in FIG. 3; and the intermediate shapes (that can occur at any point between the first configuration and the third configuration), are exemplified by the intermediate curvature shown in FIG. 4 and referred to hereafter as a second configuration, labeled as Configuration 2 in FIG. 4.

The user U can lay on the device 100 and make use of it in three basic ways. Laying on his/her back (supine), the user U can place the torso in varying degrees of extension (bending backwards), as shown in FIG. 1, thereby gradually increasing the flexibility of the torso to move in that direction. From this position the user could also perform a "roll-up", or "sit-up" type exercise, raising the torso away from the platform as the torso transforms from an extended position to a flexed position (curled forward), thus helping to strengthen the muscles required for this movement.

Laying on his/her side, the user U can place the torso in varying degrees of lateral stretch.

Figure 8:
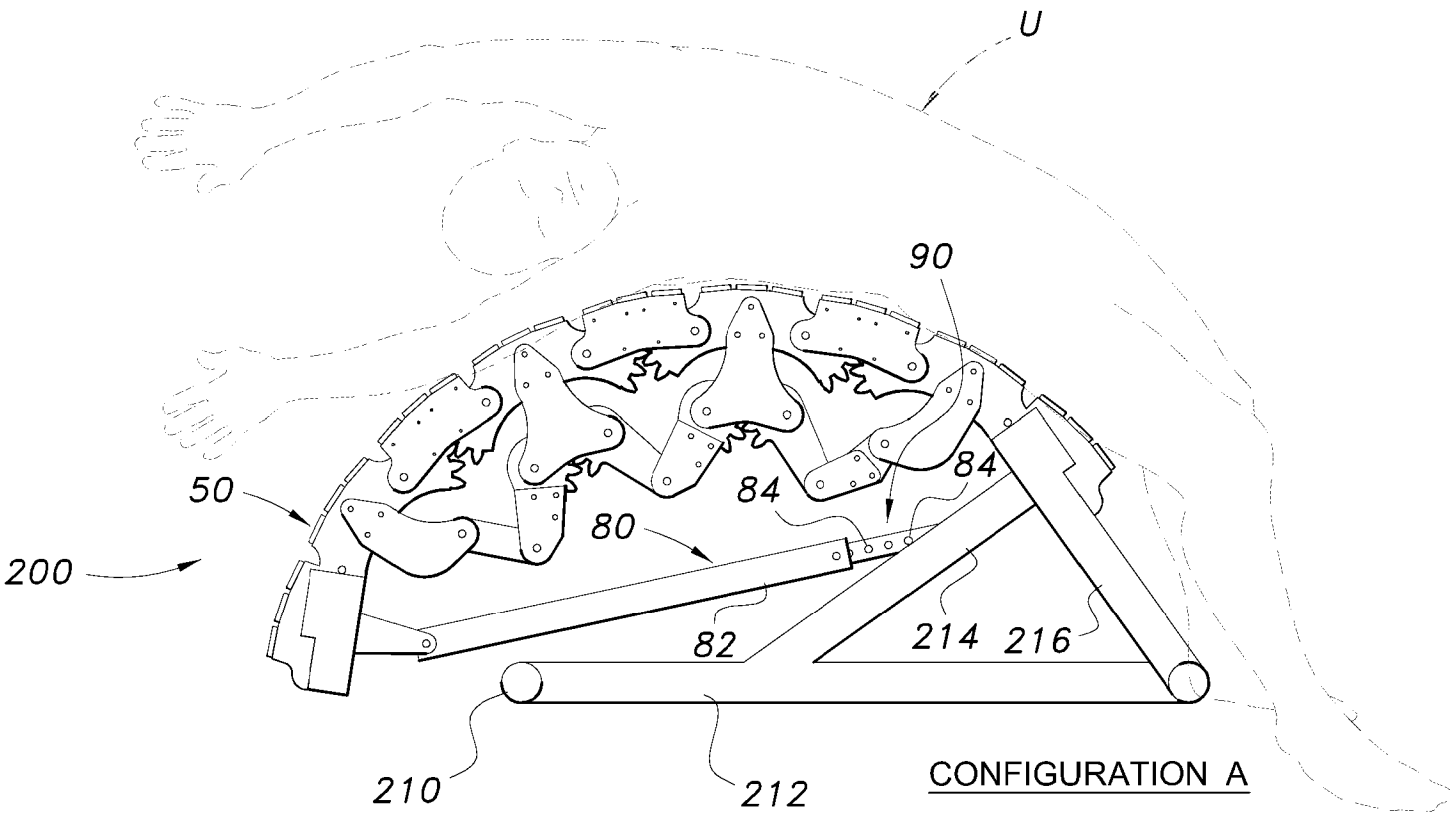
FIG. 8 is a side elevational view of a further embodiment of the present invention, having a curved platform with a support at a single end in a Configuration A which is curved at full arc, and is an environmental view shown in use with a human body shown in dashed outline.

This can be seen in FIG. 8, that type of stretching can be performed in any of the configurations.

Stretching exercises can thereby gradually increase the flexibility of the torso to move in that direction. From this position the user could also perform a "roll-up", or "sit-up" type exercise, raising the torso away from the platform 50 as the torso transforms from a lateral stretched position to a lateral flexed (curled to the other side) position, thus helping to strengthen the muscles required for this movement.

Laying on his/her stomach (prone) the user U can place the torso in varying degrees of flexion (curled forward), thereby gradually increasing the flexibility of the torso to move in that direction (this position not shown). From this position the user could also perform a "roll-up", or "reverse sit-up" type exercise, raising the torso away from the platform as the torso transforms from a flexed position to an extended position, thus helping to strengthen the muscles required for this movement.

In all of the above examples, the curvature can be in the flat configuration (FIG. 3), the full arc configuration (FIG. 1), the mid-arc configuration (FIG. 5), or anywhere in between.

The device 100 thereby provides a stretching and exercising device that is beneficial for torso strength and flexibility.

As seen in FIG. 1, the leg 10 has a foot 24, and the leg 14 has a foot 26. The leg 10 has an extending portion 12 connected by a pin 18 to the bar 82. This provides a hinged connection between the portion 12 and the bar 82. Similarly, the leg 14 has an extending portion 16 connected by a pin 88 (shown in FIG. 4) to an inner telescoping bar 90, which likewise provides a hinged connection between the portion 16 and the inner telescoping bar 90 (as shown in FIG. 4). The telescoping bar 90 is adapted to be slideable within the bar 82. The telescoping bar 90 has a series of bores 84 (i.e., openings through the bar 90) adapted to receive an adjusting pin 20 (shown in FIG. 1, and not numbered in FIG. 4) which passes through a bore (i.e. an opening) in the bar 82 which receives the pin 20 and which is disposed at the location of the pin 20. The pin 20 passes through the hole (unnumbered) at the right-hand end of the bar 82 and also passes through a respective one of the bores 84, such that the extension member 80 has a manually selectable or adjustable length. Removal of the pin 20 allows sliding relative motion between the bar 82 and the bar 90, and re-insertion of the pin 20 takes place when the user has selected the desired length of the extension member 80, thereby securing the bar 90 relative to the bar 82.

The platform 50 has a number of discrete members 32-48 (shown in FIGS. 2 and 3), i.e. these include discrete members 32, 34, 36, 38, 40, 42 44, 46 and 48. FIG. 1 shows the first discrete member 32 on the left, and the last discrete member 48 on the right.

Each of the discrete members 32-48 provides support for three slats (unnumbered) which are secured to the discrete member 32-48 by any known securement method, such as by bolts, screws, adhesive, dovetail joints, welding (in the case where metal is used), and any other method of securement that would be known to any one having skill in the construction arts. The parts shown can be made of metal, plastic, wood, and so on; in a typical use the parts would be of metal or strong plastic, and the slats would be made of wood or plastic material or padded leather, and so on. The number of slats being supported by each discrete member is not limited to three, but can include any number of slats depending on the width of each slat. The slats can be pads, for example, or any other material or shape conducive to supporting a human body.

Figure 2:
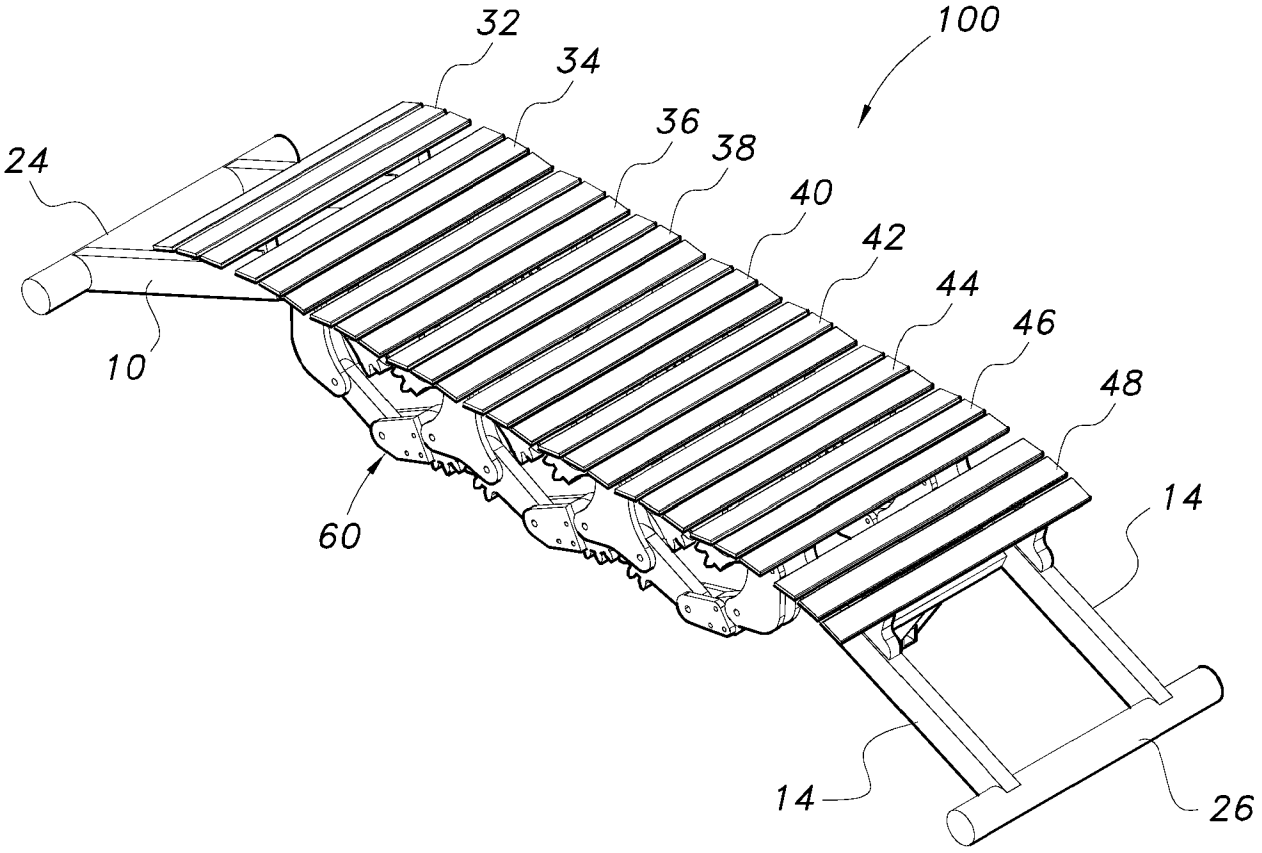
FIG. 2 is a perspective view as seen from the top and right of the embodiment of FIG. 1.

FIG. 2 is a perspective view of the device 100 as seen from the top and right of the embodiment of FIG. 1. In this view, the discrete members 32-48 are visible, and the arrangement of the gear train 60 is set so that the platform 50 (shown in FIG. 3, and unnumbered in FIG. 2 for the sake of clarity)—which is formed by the discrete members 32-48 and the slats (unnumbered) thereon—is relatively flat. That is, FIG. 2 shows a flat configuration, similar to that shown in FIG. 3.

The extension member 80 (as shown in FIG. 3) has the telescoping bar 90 fully extended; this is not visible in FIG. 2. The foot 26 and the foot 24 are visible and are seen to connect two parallel gear trains 60 (labeled and shown in FIG. 6). While two parallel gear trains 60, 60 are shown, it is contemplated that the invention can include more than two parallel gear trains, or even just a single gear train which is sufficiently strong and is approximately centrally located.

FIG. 3 is a side elevational view of the device of FIG. 1, showing the platform 50 in a flat configuration. The parts are as described in the preceding FIGS. 1 and 2. In this view, a single one of the gear trains 60 is shown. The other gear train 60 is identical.

FIG. 4 is a side elevational view similar to FIG. 3, wherein the platform is shown in the second configuration (labeled as Configuration 2 in FIG. 4) which is in mid-arc in this view. In FIG. 4, the extension member 80 is shown having the bar 82 receiving the inner telescoping bar 90 as described above, the bar 90 being slideable/adjustable within the bar 82. The bar 90 has a plurality of openings 84 as described above, which can cooperate to secure the member 90 relative to the bar 82 by insertion of a pin (unnumbered in FIG. 4, numbered as pin 20 in FIG. 1) through the corresponding aperture (unnumbered) on the rightmost end of the bar 82 in FIG. 4. The parts are as described in the preceding FIGS. 1 and 2. This view also shows a toothed arm 76 (which corresponds to the toothed arm 66) and a link member 78 (which corresponds to the link member 64).

FIG. 5 is a side elevational view similar to FIGS. 3 and 4, wherein device 100 having the platform 50 is shown in the first configuration that is in full-arc, which corresponds to Configuration 1 as labeled in FIG. 5. This view in FIG. 5 corresponds to FIG. 1, except that the phantom outline of FIG. 1 has been omitted. The parts are as described in the preceding FIGS. 1 through 4.

Figure 6:
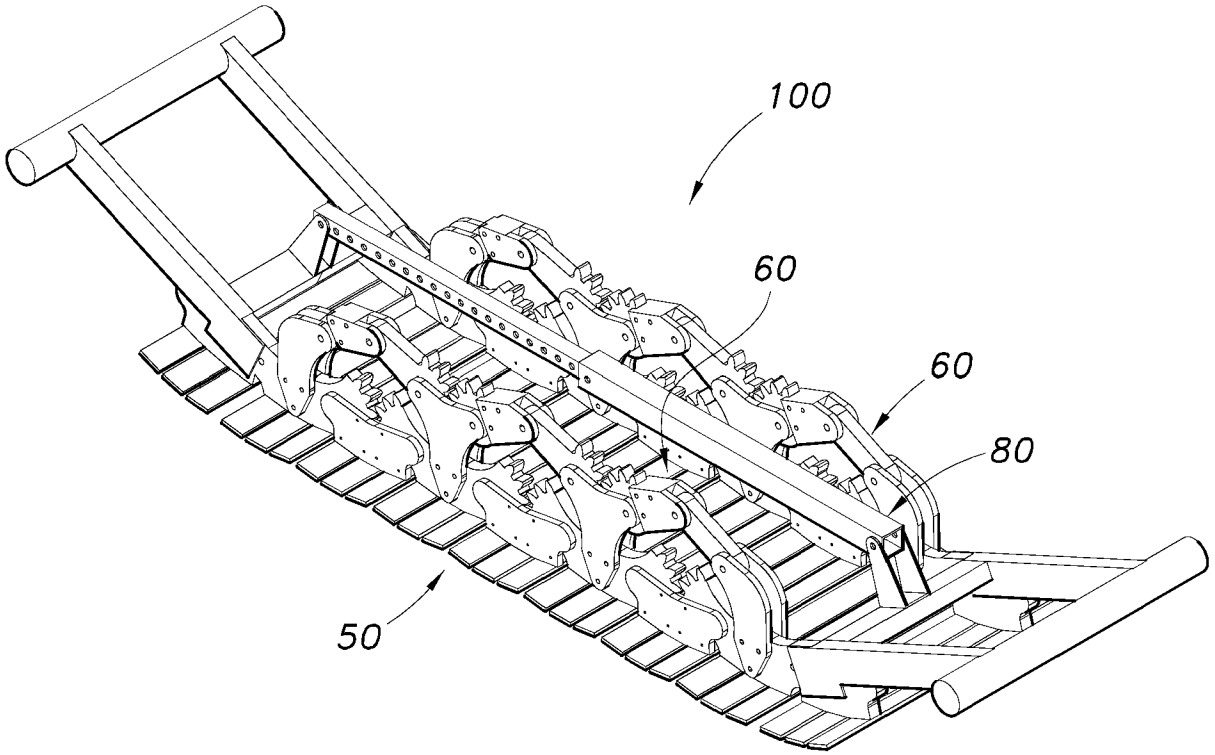
FIG. 6 is a perspective view of the device of FIG. 1 as viewed from below and to the right.

FIG. 6 is a perspective view of the device 100 of FIG. 1 as viewed from below and to the right. The gear trains are parallel gear trains 60, 60. The extension member 80 is shown clearly in this view. The parts are as described in the preceding FIGS. 1 through 5.

Figure 7:
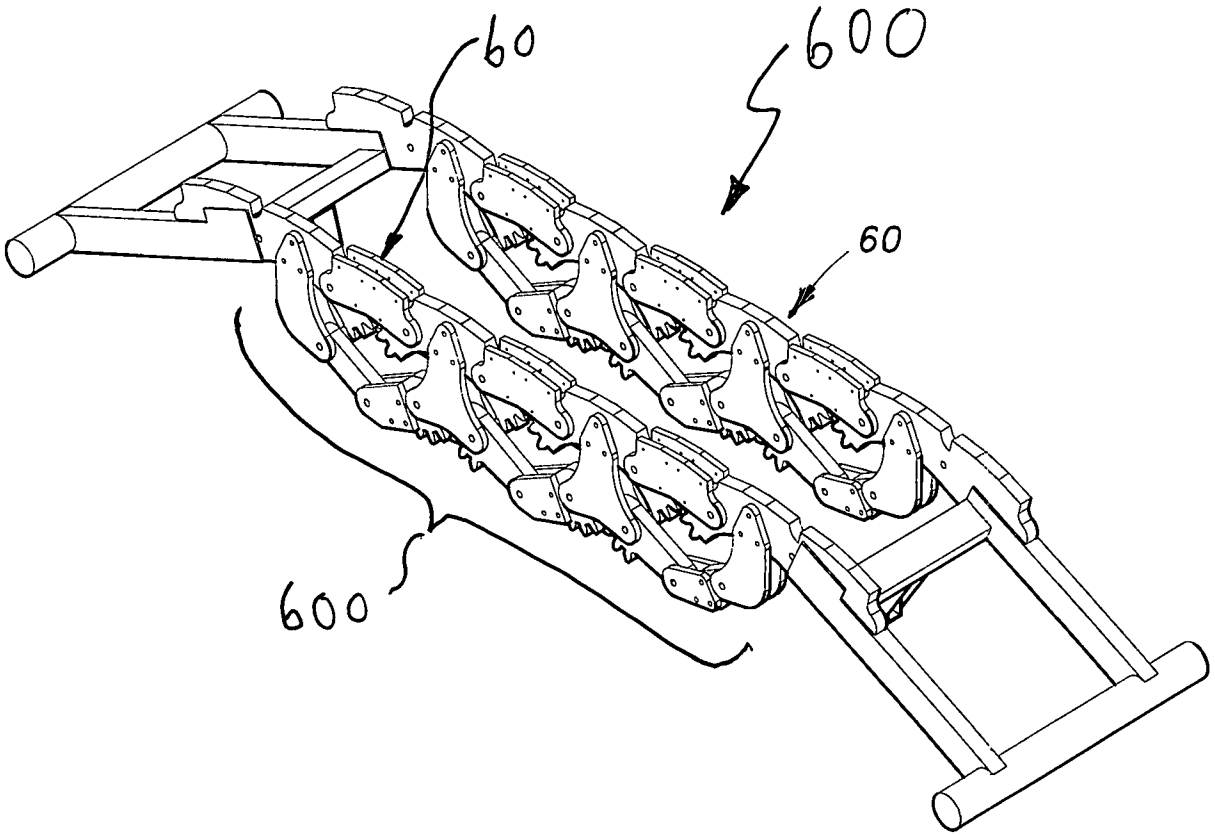
FIG. 7 is a perspective view of the device of FIG. 1, without the platform, such that the gear train is visible.

FIG. 7 is a perspective view of the device 100 of FIG. 1 from above, in the Configuration 1 of FIGS. 2 and 3, without the platform 50, such that the parallel gear trains 60, 60 are visible. The parts are as described in the preceding FIGS. 1 and 2.

In FIG. 7, a reference numeral 600 denotes the entire assembly of FIG. 7, and is referred to herein as an adjustable support 600. Similarly, a reference numeral 670 in FIG. 14 denotes an adjustable support.

FIG. 8 is a side elevational view of a further embodiment of a device 200 of the present invention, having a curved platform 50 with a support at a single end in a first embodiment (labeled as Configuration A in FIG. 8) which is curved at full arc, and is an environmental view shown in use with a User U having a human body shown in dashed outline. The support includes a base arm 212 having an end 210, and a first upstanding portion 214 and a second upstanding portion 216, the arm 212 together with the portion 214 and the portion 216 forming a triangle.

The portion 216 is fixed to the right end of the gear train 60. The angle between portion 212 and portion 216 is shown in a specific position in FIG. 8, but this angle is not necessarily fixed. For example, an adjustment can be provided so that portion 216 can pivot relative to portion 212, portion 214 can pivot relative to portion 216, and the connection point between portions 212 and 214 is variable, thus providing a means of adjustment of the height and incline of the curved platform 50 (shown numbered in FIG. 10, and shown but not numbered in FIG. 8 for the sake of clarity). These variations are all contemplated as being within the scope of the present invention. The variations described above with regard to FIGS. 1-7 are also contemplated as being usable in the embodiment of FIGS. 8-14.

The parts are as described in the preceding FIGS. 1-7. The embodiment of FIGS. 8-14 illustrates that only a single support can be used; while the support shown is on the right-hand side, it could instead be disposed at the left-hand side, and all such variations are contemplated as being within the scope of the present invention.

Figure 9:
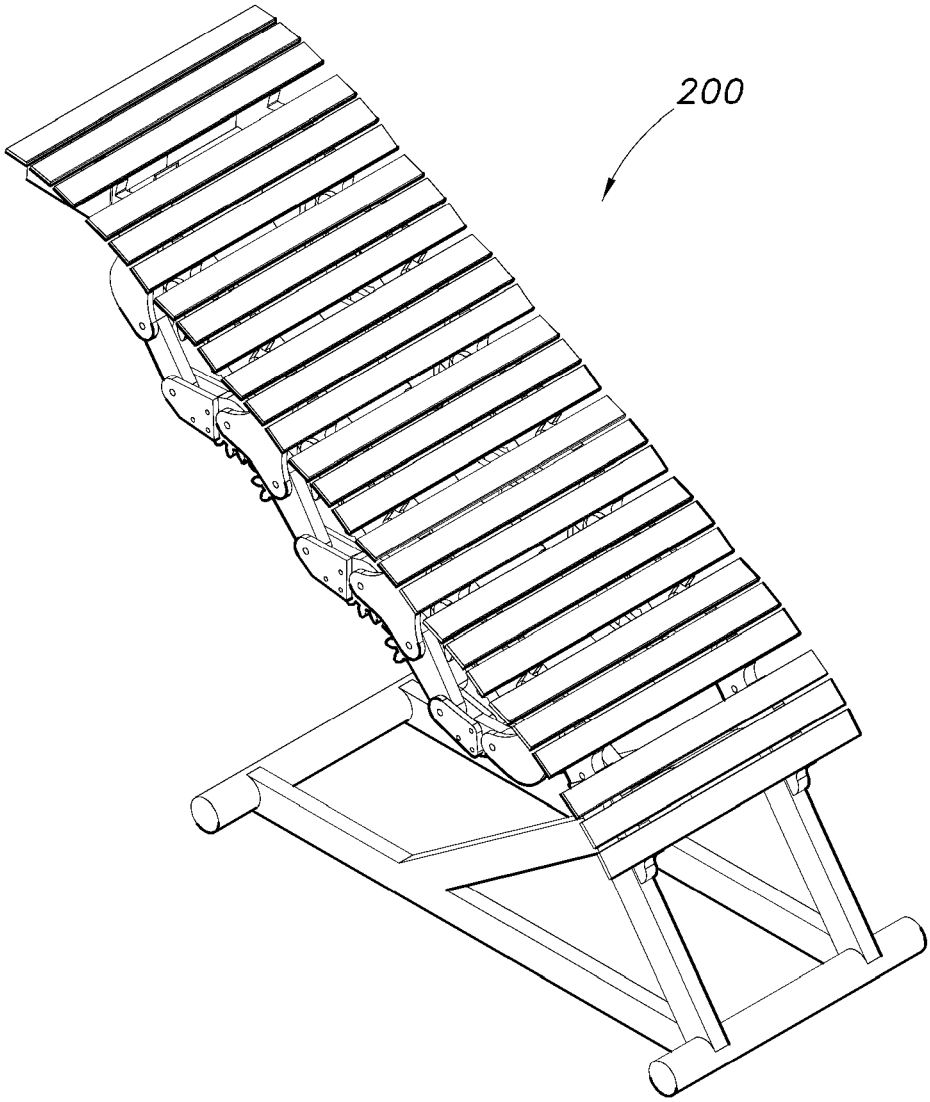
FIG. 9 is a perspective view of the further embodiment of FIG. 8, shown in a Configuration B wherein the platform is substantially flat.
Figure 10:
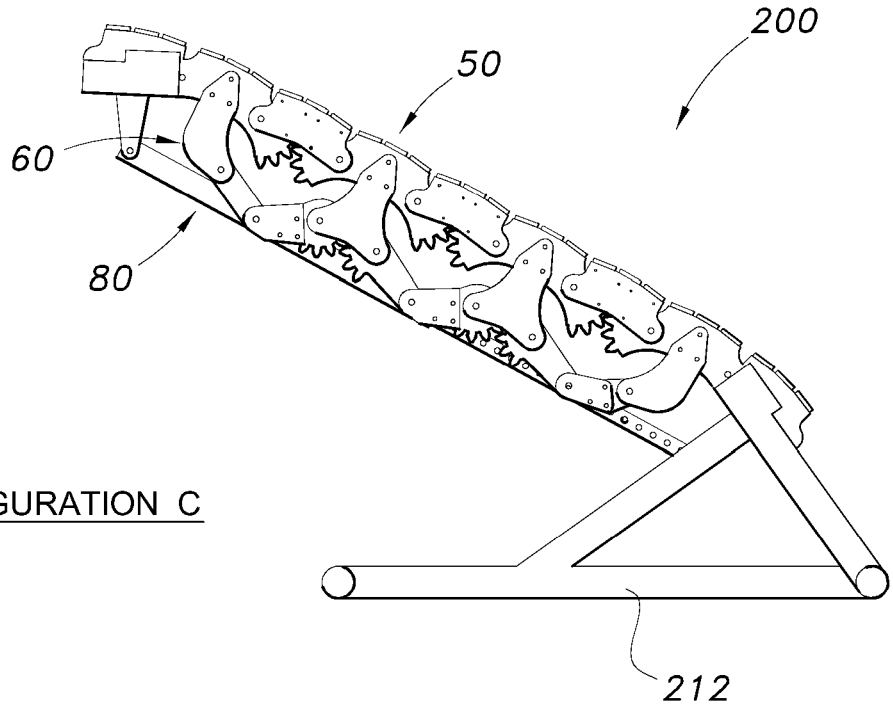
FIG. 10 is a side elevational view of the embodiment of FIGS. 8 and 9, shown in the Configuration B as shown in FIG. 9.

FIG. 9 is a perspective view of the further embodiment of the device 200 of FIG. 8, shown in a configuration which is relatively flat, and which corresponds generally to FIG. 10 wherein the platform is substantially flat. The parts are as described in the preceding FIGS. 1 and 8.

FIG. 10 is a side elevational view of the device 200 of the embodiment of FIGS. 8 and 9, and FIG. 10 is shown in a third configuration which is relatively flat, and is labeled as Configuration C as shown in FIG. 10. This view shows the platform 50, gear train 60, and extension member 80.

Figure 11:
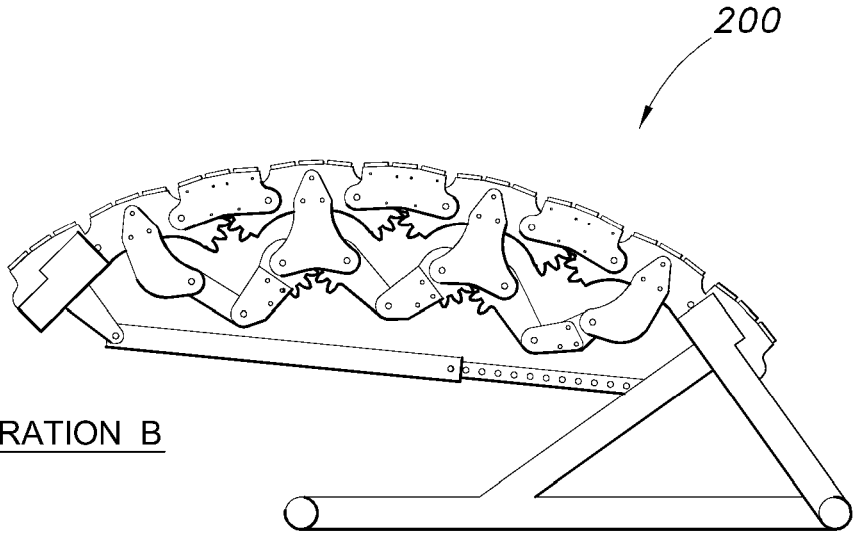
FIG. 11 is a side elevational view of the embodiment of FIG. 8, shown in a Configuration C which is curved in a mid-arc position that is intermediate between Configuration A and Configuration B.

FIG. 11 is a side elevational view of the device 200 of the embodiment of FIG. 8, shown in a second configuration which is labeled in FIG. 11 as Configuration B which is curved in a mid-arc position that is intermediate between Configuration A and Configuration C. The parts are as described in the preceding FIGS. 1-10. It will be understood that the second configuration (i.e. Configuration B) can have any degree of curvature ranging between that of Configuration A and that of Configuration C.

Figure 12:
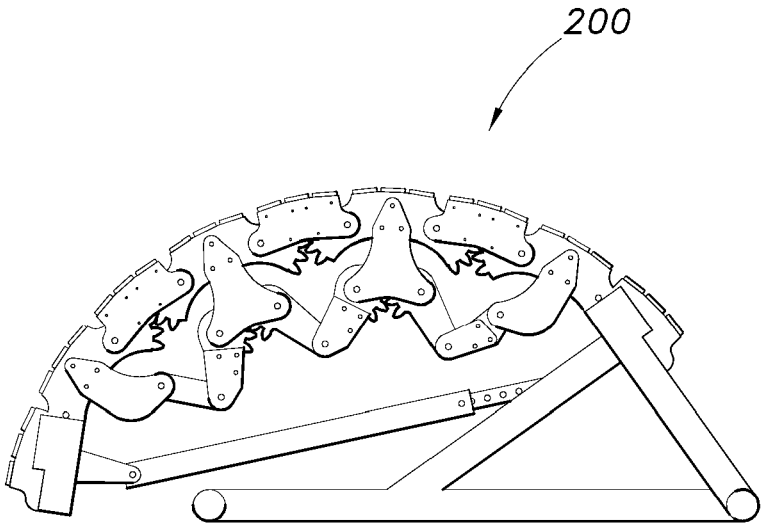
FIG. 12 is identical to FIG. 8, except that it omits the body of the user.

FIG. 12 is identical to FIG. 8, showing the device 200, except that it omits the body of the user.

Figure 13:
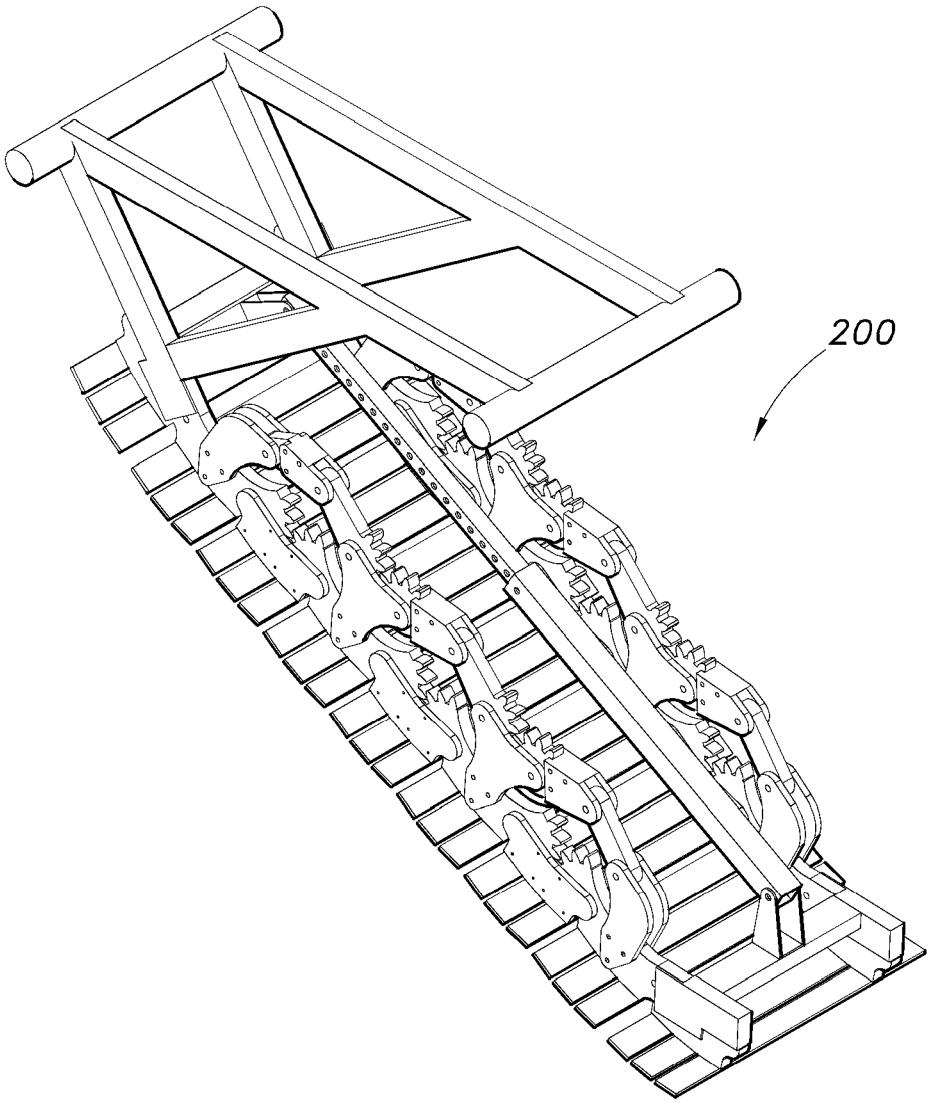
FIG. 13 is a perspective view of the device of FIG. 9, shown from below so that a gear train is visible.

FIG. 13 is a perspective view of the device 200 of FIG. 9, shown from below so that the pair of gear trains 60, 60 is visible. The parts are as described in the preceding FIGS. 1 through 12.

Figure 14:
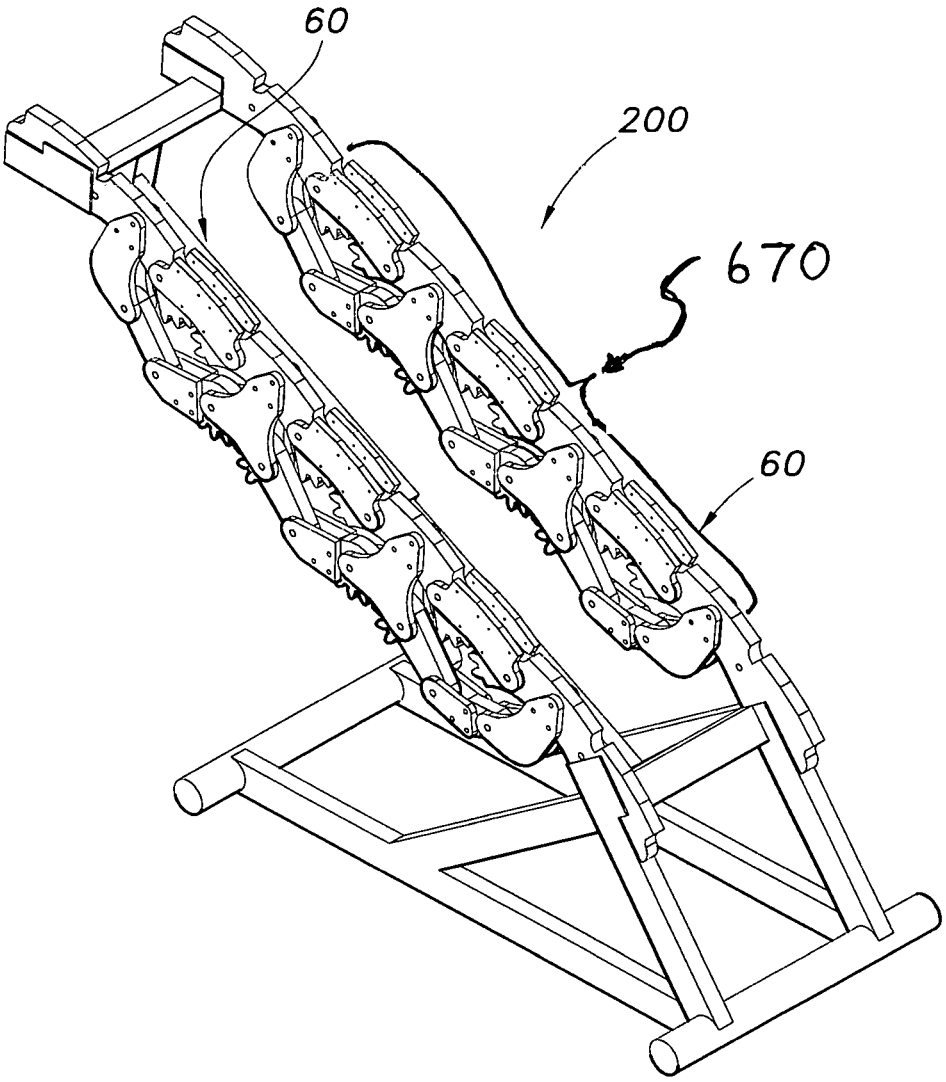
FIG. 14 is a perspective view of the device of FIG. 9, shown without the platform, so that the gear train is visible.

FIG. 14 is a perspective view of the device 200 in a flat configuration, and this view is similar to FIG. 9 except that FIG. 14 omits the platform 50, so that the gear train pair 60, 60 is visible. The parts are as described in the preceding FIGS. 1 through 13.

Figure 15:
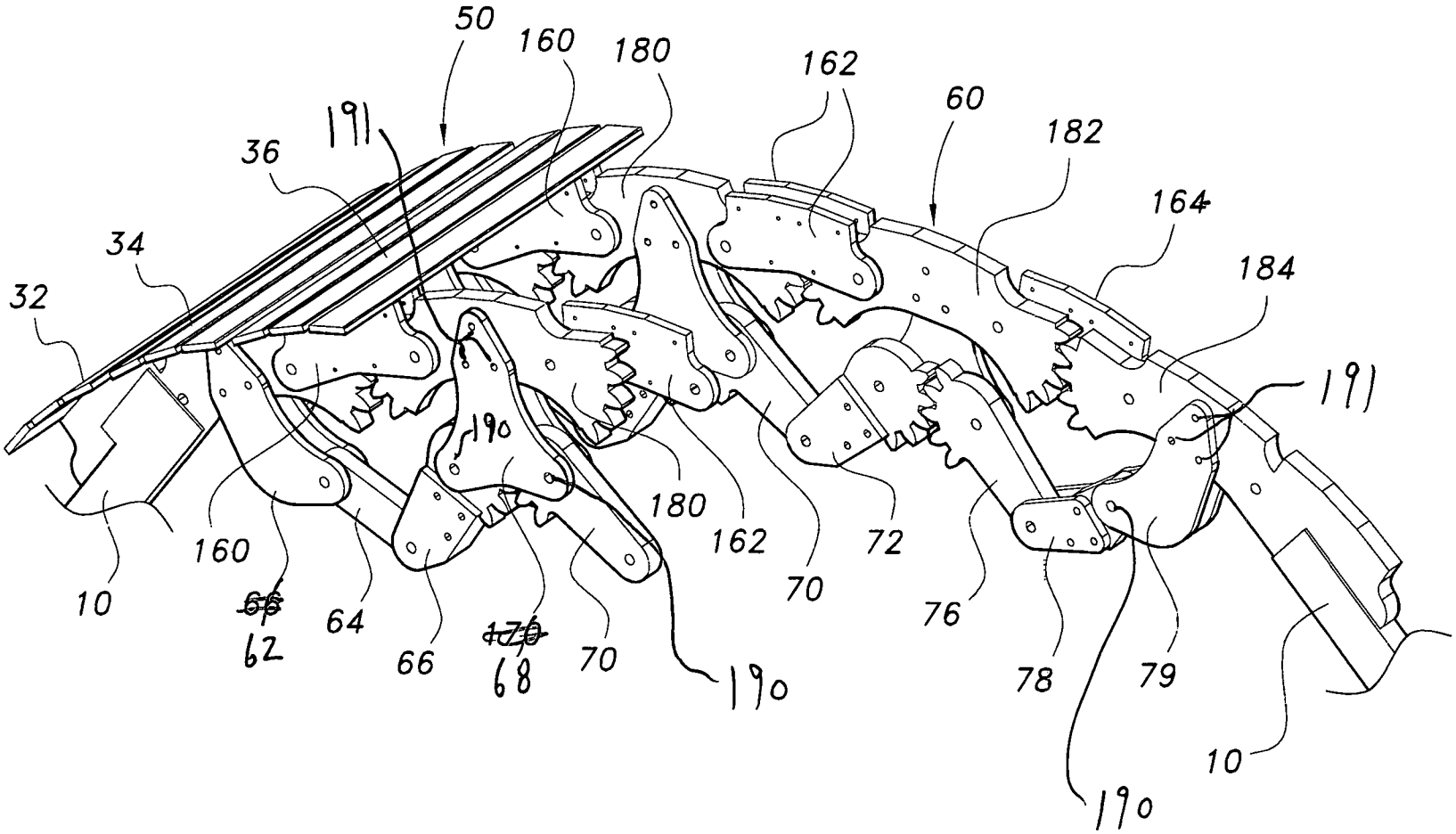
FIG. 15 is an enlarged view of the gear train of the embodiments of FIGS. 1 and 8, broken away showing details of the construction of the gear train.

FIG. 15 is an enlarged view of the gear train 60 of the first embodiment of FIGS. 1-7 and the second embodiment of FIGS. 8-14, the parts being broken away to show details of the construction of the gear train 60. A first gear train 60 is shown partially broken away, so that the interaction of the parts is visible. The support 10 is fixed to a leftmost end of the gear train 60 beneath the discrete member 32, and is fixedly connected to a leftmost side of a connecting member 62, whose rightmost end is connected to a link member 64 at a pin connection (unnumbered in FIG. 15) so that it is hinged. A similar connecting member 79, identical to connecting member 62 is shown at the opposite end of the gear train 60. The connecting member 64 is connected to a toothed arm 66, whose teeth engage corresponding teeth of an adjacent toothed arm 70. The toothed arms 66 and 70 are held in engagement by a connector 68 which is connected by respective pins 190 to the arms 66 and 70 such that they are pivotable; the connector 170 of FIG. 15 is secured to an adjacent one of the double-ended toothed members 180 by three pins 191 which secure it against rotation. A link member 78 is identical to the link member 64, and a toothed arm 76 is identical to the toothed arm 66. As seen in FIG. 4 and FIG. 15, elements 62, 64, 66, and 70 are mirrored by the respective elements 79, 78, 76, and 72. An uppermost end of the connector 68 is fixedly connected by three pins (such as the pins 190 shown on the other gear train 60 in FIG. 15) so that is cannot rotate relative to a double-ended toothed member 180. The member 180 is pinned to a support element 160, wherein the support element 160 directly supports the discrete member 34 having overlying slats (unnumbered) of the platform 50. Additional single-ended members 184 (four total, one at each end of the two gear trains 60, 60) are provided to engage with double-ended toothed members 182. The members 184 are respectively fixed to the legs on the non-toothed end side and are respectively in toothed engagement at their other, toothed ends, with the respective ones of the members 182. Pins 191 fix the connecting member 79 to the single-ended connecting member 184.

As to the other double-ended toothed members (180, 182, etc.), the rightmost end of a first double-ended toothed member (such as member 180) engages with the leftmost toothed end of a second double-ended toothed member (such as member 182). There are a plurality of like elements of each type described above, as will be evident from inspection of FIG. 15, forming the gear train 60.

Figure 16:
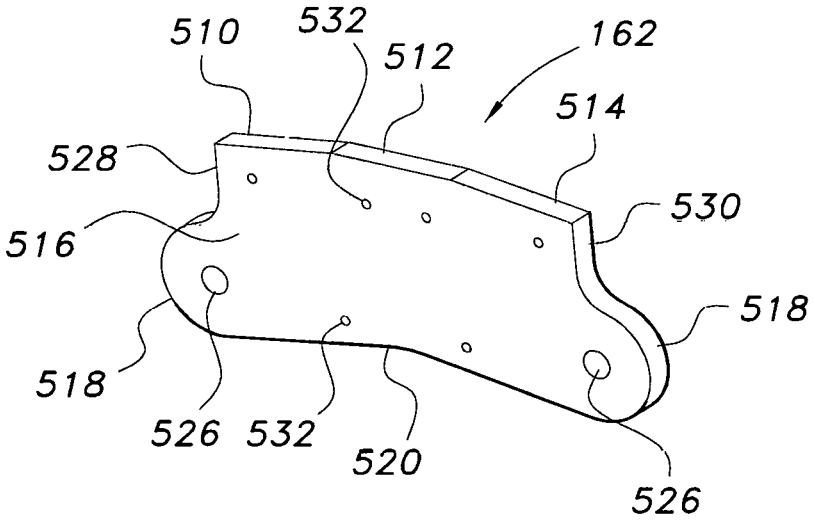
FIG. 16 is an enlarged frontal view of a connecting member, which is used in the device of the present invention.

FIG. 16 is an enlarged frontal view of a connecting member 162, which is used in the device 100 of the present invention. The connecting member 162 has a body 516, a top edge having three slat support regions 510, 512, and 514, opposed upstanding side walls 528 and 530, and opposed ears 518, 518. Each of the ears has a respective bore 526 for receiving a pin, and the body 516 is shown as having a plurality of holes 532. The holes 532 can be omitted, as having no function in the device shown, and if provided they can be used for connection to possible further accessories such as those mentioned above. The connecting member 162 has a lower most edge 520.

FIG. 15 shows a connecting member 164, which is identical to the connecting member 162 described above.

Figure 17:
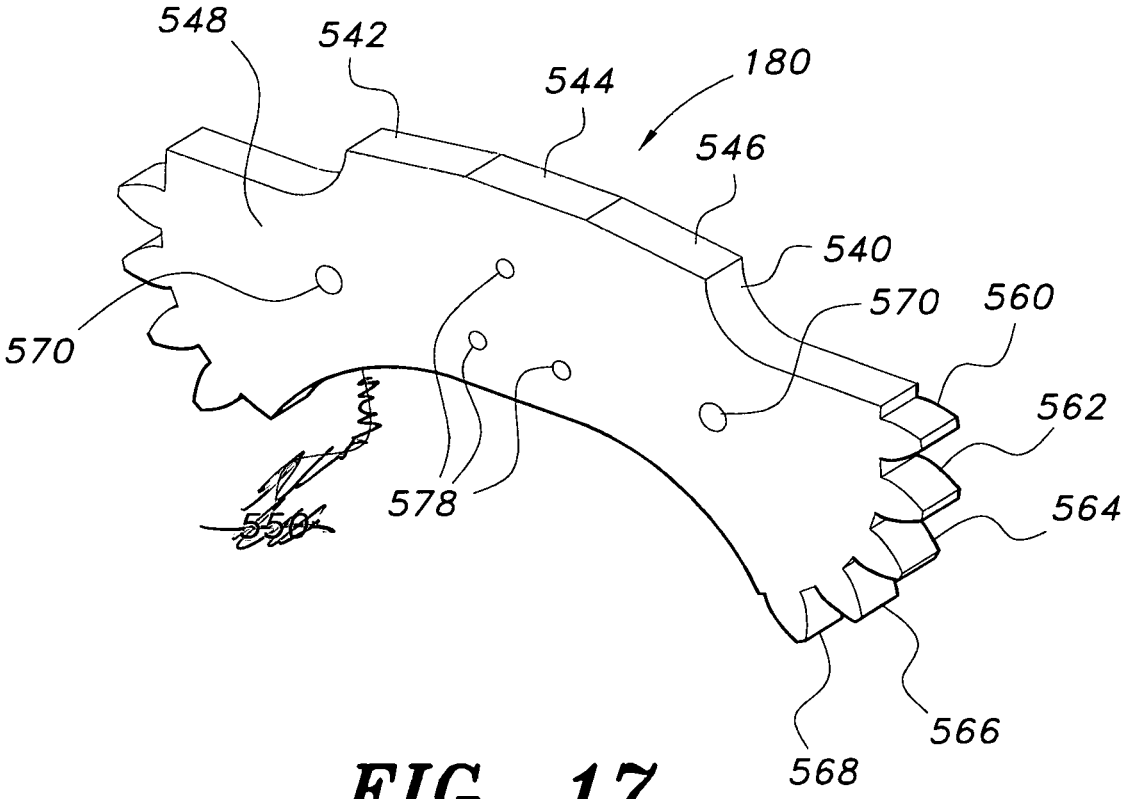
FIG. 17 is an enlarged frontal view of a gear-toothed member, which is used in the device of the present invention.

FIG. 17 is an enlarged frontal view of the double-ended toothed member 180, which is used in the device 100 and the device 200 of the present invention. The double-ended toothed member 180 has a body 548, a top edge having three slat support portions 542, 544, and 546, and opposed side walls 540. The body 548 has two bores 570, 570 for receiving respective pins, and has a plurality of bores 578 for receiving securing bolts or pins. The double-ended toothed member 180 has a rightmost end which has teeth 560, 562, 564, 566, and 568. Both ends, though similar in shape, are not identical—basically one end is "male", the other "female".

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed is:

1. A variable arching support for use in stretching and exercise, comprising:

a gear train movable into a first configuration to form an intermediate arc and a second configuration having a relatively flat arc, and said gear train having a first end and a second end which is distal from said first end, a platform supported by said gear train, said platform comprising a plurality of discrete members, a first support leg supporting said first end of said gear train; and a second support leg supporting said second end of said gear train, and an extension member which connects said first support leg and said second support leg, said extension member being extendable being a first position and a second position to cause movement of said gear train between said first configuration and said second configuration, wherein said first position of said extension member corresponds to said first configuration of said gear train, and wherein said second position of said extension member corresponds to said second configuration of said gear train.

2. A variable arching support as claimed in claim 1, wherein said extension member includes a manually repositionable pin.

3. A variable arching support as claimed in claim 1, wherein said extension member includes a bar and an inner telescoping member, wherein said bar receives said inner telescoping member in sliding engagement.

4. A variable arching support as claimed in claim 2, wherein said inner telescoping member has a plurality of holes therein to receive said repositionable pin, and wherein said bar has at least one hole for receiving said repositionable pin, so that insertion of said repositionable pin secures said bar to said inner telescoping member, to secure said bar against sliding relative to said inner telescoping member.

5. A variable arching support as claimed in claim 1, wherein said gear train comprises in series a connecting member, a link member, a toothed arm, and a connector; said platform further comprising a double-ended toothed member and a connecting member; and wherein said connecting member is pivotably connected to said toothed arm; and wherein said toothed arm is pivotably connected to said connector; and wherein said connector is fixedly connected to said double-ended toothed member of said platform.

6. A variable arching support for use in stretching and exercise, comprising:

a gear train movable into a first configuration to form a maximum arc, a second configuration to form an intermediate arc, and a third configuration having a relatively flat arc; and said gear train having a first end and a second end, said second end being distal from said first end, a platform supported by said gear train, said platform comprising a plurality of discrete members, said platform being adapted to support a human body, a first support leg supporting said first end of said gear train; and a second support leg supporting said second end of said gear train, and an extension member which connects said first support leg and said second support leg, said extension member being extendable being a first position, a second position, and a third position to respectively cause movement of said gear train between said first configuration, said second configuration, and said third configuration; wherein said first position of said extension member corresponds to said first configuration of said gear train, wherein said second position of said extension member corresponds to said second configuration of said gear train, and wherein said third position of said extension member corresponds to said third configuration of said gear train.

7. A variable arching support for use in stretching and exercise, comprising:

a gear train movable into a first configuration to form a first arc, and movable into a second configuration to form a second arc which is different from said first arc; and said gear train having a first end and a second end, said second end being distal from said first end, a platform supported by said gear train, said platform comprising a plurality of discrete members, said platform being adapted to support a human body;

a first support member supporting said first end of said gear train; and a second support member supporting said second end of said gear train, and an extension member which connects said first support member and said second support member, said extension member being extendable through a range of positions, including a first position and a second position, to respectively cause movement of said gear train between said first configuration and said second configuration; wherein said first position of said extension member corresponds to said first configuration of said gear train, wherein said second position of said extension member corresponds to said second configuration of said gear train.

* * * * *